United States Patent [19]

Ingemann

[11] Patent Number: 4,836,401

[45] Date of Patent: Jun. 6, 1989

[54] CONTAINER FOR LIQUIDS AND METHOD FOR FILLING AND SEALING THE CONTAINER

[75] Inventor: Ole Ingemann, Ryslinge, Denmark

[73] Assignee: PLM AB, Malmo, Sweden

[21] Appl. No.: 156,925

[22] PCT Filed: Jun. 17, 1987

[86] PCT No.: PCT/SE87/00284

§ 371 Date: Feb. 9, 1988

§ 102(e) Date: Feb. 9, 1988

[87] PCT Pub. No.: WO87/07879

PCT Pub. Date: Dec. 30, 1987

[30] Foreign Application Priority Data

Jun. 19, 1986 [SE] Sweden ..... 8602744

[51] Int. Cl.[4] ..... B65D 21/00

[52] U.S. Cl. ..... 220/83; 220/74; 220/306

[58] Field of Search ..... 220/83, 74, 306

[56] References Cited

U.S. PATENT DOCUMENTS

| | | | |
|---|---|---|---|
| 3,128,002 | 4/1964 | Buchanan | 220/83 X |
| 3,642,162 | 2/1972 | Doman et al. | 220/74 X |
| 4,113,095 | 9/1978 | Dietz et al. | 220/74 X |
| 4,541,542 | 9/1985 | Florentino | 220/306 |
| 4,754,874 | 7/1988 | Haney | 220/306 X |

*Primary Examiner*—Steven M. Pollard

*Attorney, Agent, or Firm*—Roberts, Spiecens & Cohen

[57] ABSTRACT

A container (1) consists of a container body (10) and a container lid (20) which, in a factory-sealed container, sealingly closed the lid in circumferential connection (21). In such instance the lid constitutes a bounding definition of the storage space, the lid being of a disposition entailing that bounding portions of the lid are located more proximal the standing surfaces of the container than other portions.

14 Claims, 2 Drawing Sheets

CONTAINER FOR LIQUIDS AND METHOD FOR FILLING AND SEALING THE CONTAINER

FIELD OF THE INVENTION

The present invention relates to a container having an open mouth which is sealed by a lid after the contents of the container have been filled therein.

BACKGROUND

In the packaging art, it is a general desideratum to be able to design containers and lids such that, in each filled container, its storage space is utilized to the most efficient possible extent. It is also of considerable importance that the space—often termed the 'headspace'—between the filling goods and the closure (lid) of the container be minimized in order that, when the filling goods include liquid, the space above the surface of the liquid be as small as possibly and thereby the negative action which this space may, in many physical applications, exercise on the enclosed goods be minimized. This requirement applies in particular to goods in which solid matter or bodies are included whose quality runs the risk of deterioration if the bodies are not wholly submerged and surrounded by the liquid. Examples of applications in which such a minimization of this space is of crucial value are containers for the storage of herrings in brine. These demands for minization of the space between the liquid surface and the closure of the container are accentuated in physical applications in which the container has a low proportional ratio between its height and its circumference.

One drawback inherent in the employment of as slight a space as possible between the liquid surface and the opening edges of the open container is that in and/or after the filling operation with filling goods, the liquid may unimpeded run or slop over the opening edge and thereby cause problems in conjunction with the filling of the container.

In particular in containers with a low proportional ratio between the container's height and its circumference—and in which there is a need for but a slight space between the closure and the filling surface, it is difficult to guarantee the opened container sufficient space between the filling surface and the opening edges of the container in order to preclude liquid from slopping over the opening edges, for example when the opened container is set on a table.

In containers which are subject to the requirement of small space between the closure or sealing and the liquid surface, it is a not uncommon occurence that the liquid level will be too high in physical applications in which the filling goods include, apart from the liquid, solid bodies—and in particular when these are added manually (for example in the packing of soused herring). This is because the total volume of the solid bodies added to the container varies from container to container.

SUMMARY OF THE INVENTION

The present invention seeks to a container which satisfies the above-outlined criteria and in which the drawbacks considered in the foregoing are obviated. This is attained in that the container is sealed with a lid at an acute angle to the supporting surface of the container.

In one preferred embodiment, the container body is provided with a shoulder or ledge located in the opening of the container body, the shoulder being at least partly countersunk in relation to the upper edge of the opening and surrounding the opening interiorly, against which shoulder the lid of the container is connected by means of at least one part of the sealing connection between the lid and the container body.

The nature of the present invention and its aspects will be more readily understood from the following brief description of the accompanying drawings, and discussion relating thereto.

BRIEF DESCRIPTION OF THE FIGURES OF THE DRAWING

In the accompanying drawings

DETAILED DESCRIPTION

Figure 1:
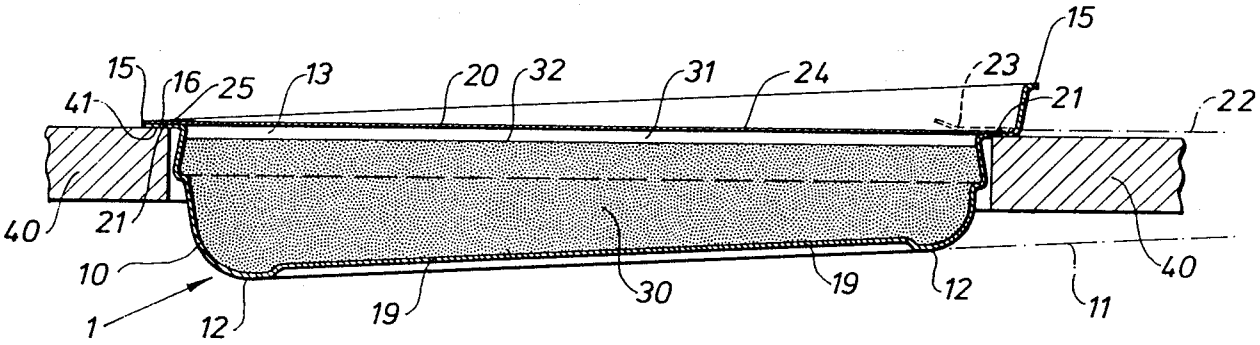
FIG. 1 is a section through a container in the filling position.

Referring to the drawings, there is shown a container 1 with a container body 10, 10*a* in which is included a sealed bottom 19 and an opening portion or mouth 13. A lid 20 which is provided with a central lid panel 24 surrounded by an edge region 25, is, in its range region, connected, by means of one or more sealing and continuous joints 21, around the opening to the opening portion of the container body. As a rule, each joint consists of a glued or welded seam joint. Generally, the joints are of tear-off design, whereby the opening of the closed container 1 will be facilitated. In the drawings, the lid is illustrated in one preferred embodiment according to which it is designed as a foil or membrane. The bottom 19 of the container body is provided with one or more standing surfaces 12 located in a plane 11. In one preferred embodiment, one or more circumferentially extending standing surfaces are employed. In the illustrated embodiment, the opening 13 of the container body is provided with a continuous shoulder or leg 14 which, as a rule, is disposed but partly to surround the opening interiorly and is at least partly countersunk in relation to an opening edge surface 15 which constitutes an upper bounding surface for the opening 13 of the container body 10. In other embodiments, the shoulder or ledge surrounds the entire opening and, in this instance, is countersunk in relation to a most proximally located opening edge surface 15. In the embodiments illustrated in the drawings, the opening edge portion merges into a portion of the opening in a flared flange 16 with an upper bounding surface 17. The distance between the shoulder 14 and the opening edge surface 15 varies around the circumference of the opening portion and is at its greatest in the one end region of the container body, this region being, in the embodiment provided with the flared flange 16, located opposite the flange.

Figure 4:
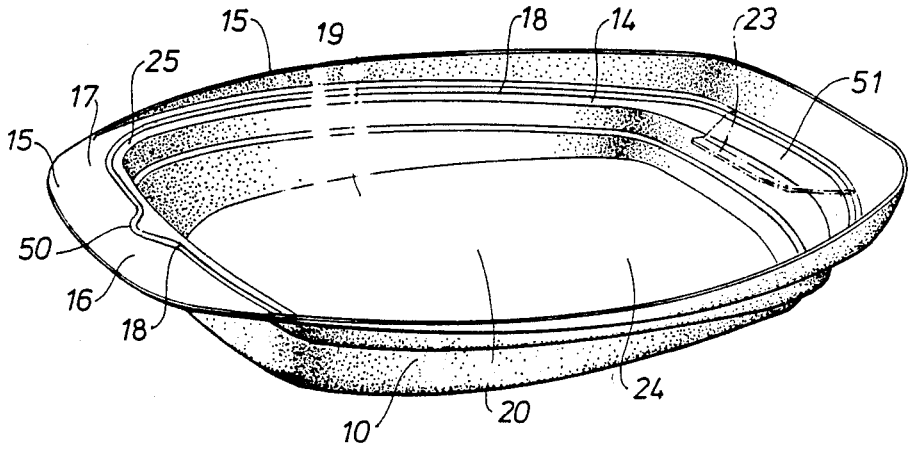
FIG. 4 is an oblique perspective view from above of a first embodiment of a container according to the present invention.

In the embodiments shown on the drawings, the lid is continuously and sealingly connected to the flared flange 16 as well as to the shoulder or ledge 14 by means of the joint or joints 21, respectively. As a rule, the shoulder and the flared flange, respectively, are provided with at least one continuous and generally circumferentially extending ridge 18 to which the lid is connected in a factory-sealed container. In FIG. 4, the ridge is shown with a top 50 which, according to the embodiment illustrated in FIG. 4, is disposed on the flared flange 16. The provision of the tip reduces the magnitude of the rupture forces required for initiating, on opening of the factory-sealed container, the separation of the lid from the ridge 18. The ridge is disposed on the upper surface of the shoulder 14 and, in the embodiments shown on the drawings, continues along the upper bounding surface of the flared flange 16. The joint 21 is located in a plane 22 which makes an acute angle with the plane 11 through the standing surface 12 of the container and also makes an acute angle with the opening edge surface 15. As a rule, this angle is of the order of magnitude of between 2° and 15°. The above-described construction refers to an embodiment which satisfies the disposition, as called for according to the present invention, of that defining bounding of the storage space constituted by the lid, namely a disposition in which bounding or definition portions of the lid are located more proximal the standing surface or surfaces of the container than other portions.

In FIG. 4, an alternative embodiment is shown by broken lines, according to which a folded portion 23 of the lid forms a gripping device for opening the factory-sealed container. The folded lid portion is illustrated in one embodiment in which it is located in a region of the opening where the distance between the opening edge 15 and the shoulder 14 is at its greatest. As a rule, the shoulder is here provided with a broader portion 51 in order to make room for the design of the ridge 18. In FIG. 4, it is assumed that the lid consists of a translucent material.

In certain embodiments, the edge portion 25 of the lid 20 is located at a level which differs from the level of the lid panel 24. In such instance, the orientation of the lid panel is such as to correspond substantially with the orientation of the edge region.

In the figures, filling goods supplied to the container is designated by reference numeral 30. In the figures, the filling goods are denoted as consisting of a liquid whose surface is designated 32. In certain physical applications, the liquid consists of a brine solution in which, for instance, herring or herring pieces are stored. A stratiform space 31 is formed between the lid and the lid surface 32, the space being, in FIG. 1, of substantially uniform thickness, while, in FIG. 2, it is of cuneiform cross section. The volumes of these spaces substantially agree in both Figures.

FIG. 1 shows a retainer 40 provided for supporting the container body against the underside of the shoulder 14 and against the underside of the flared flange 16. The upper abutment surface 41 of the retainer 40 for copoeration with the underside of the shoulder 14 and the flared flange 16 is located substantially in the horizontal plane. The plane 22, whose orientation corresponds to the orientation of that plane in which the connection or joint 21 is located, will consequently be of an orientation which lies substantially in the horizontal plane. In the embodiments shown in the drawings, the orientation of the plane 22 has its counterpart in the plane in which the upper bounding surface of the shoulder 14 and the upper bounding surface 17 of the flared flange 16 are located.

Figure 2:
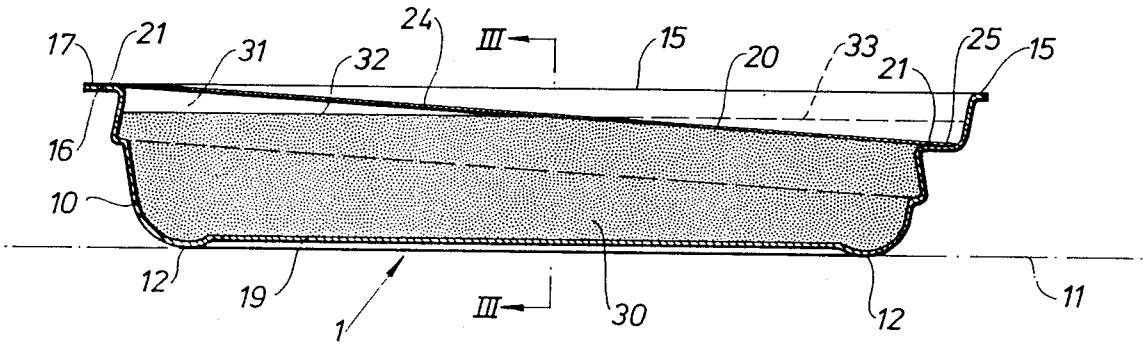
FIG. 2 is a section through a closed and sealed container in the storage and opening positions.
Figure 3:
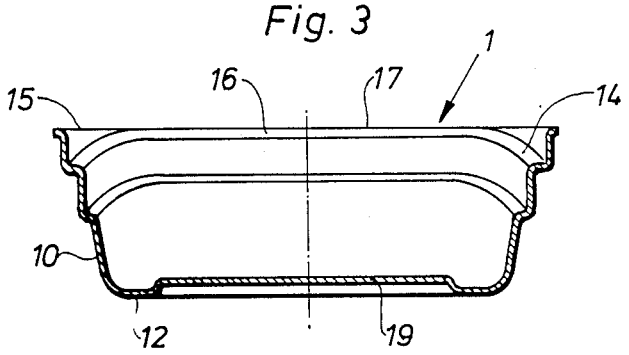
FIG. 3 is a section taken along the line III-III in FIG. 2.

FIG. 2 shows a section of the factory-sealed container placed on a substantially horizontal substrate and with the container resting on the substrate by means of the standing surface 12. It will be apparent from this drawing figure that the extent of the space 31 has been reduced, in that a portion of the lid 20 is located below the level 33 which the liquid surface would have assumed if the lid had not prevented the liquid from assuming that level. As a result of the reduced extent of the space 31, and thereby of the liquid surface 32, the risk is reduced that, for example herring packed in brine would rise above the surface of the liquid.

Figure 5:
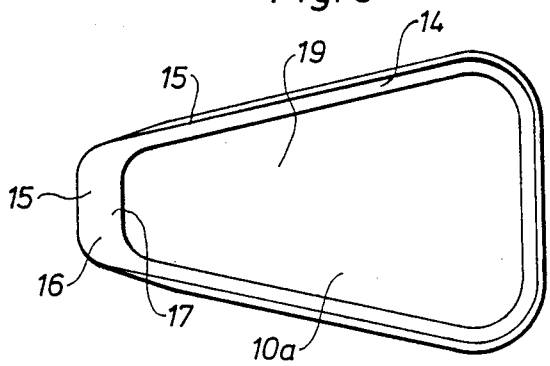
FIG. 5 is a top plan view of an alternative embodiment of the container body.

FIG. 5 shows an embodiment in which the container body is of a design which entails that when the closed container is placed on a flat substrate, the size of the liquid surface 32 is reduced in comparison with that which applies for substantially rectangular containers, at the same time as the thickness of (the height of) the stratiform space 31 is increased in the region most proximal the flared flange 16.

When a container is to be filled, it is placed in the retainer 40 and a pre-determined amount of liquid, for instance brine, is filled into the container. Thereafter, the solid bodies such as herring pieces are, where applicable, added, the liquid level rising somewhat. Such packing of these solid bodies if often effected manually, with the result that the number of bodies thus packed and the total volume thereof may vary slightly from container to container and thereby also the liquid levels which are obtained in each container. The shoulder 14 and the flared flange 16 are located in the horizontal plane, for which reason overfilling of the container will be prevented because any possible excess liquid will run out over the flared flange 16. In those physical applications where the liquid is supplied in a pre-determined amount once the bodies have been placed in the container, a corresponding overflow drainage of liquid will, naturally, take place.

When the filling operation is completed, the lid is sealingly connected, by means of one or more joints 21 which are formed by, for instance, heat welding, ultrasonic welding, hot melt etc., to the upper side of the shoulder 14 and, where applicable, to the flange 16. The ridge 18 ensures that no liquid gathers in the region where the sealing connection between the container body and the lid is established. This procedure avoids the risk of untight closure of the container in applications in which, for instance, the choice of materials for the lid and container body—in combination with the connection technology employed—entails a risk of untight connection at points where liquid might gather.

During transport and in opening of the factory-sealed container, the container is of an orientation which corresponds to that illustrated in FIG. 2. This implies that the opening edge surface 15 of the container body is located substantially in the horizontal plane and, thereby, at approximately equidistant spaced relationship from that level the liquid surface assumes in conjunction with the opening of the container. The distance between the upper bounding surface of the opening edge surface 15 and the liquid surface will, thereby, be sufficiently great to minimize the risk that liquid slops over the opening edge surface in conjunction with opening of the container or when the container is handled while being opened.

The above detailed description has referred to but a limited number of embodiments of the present invention, but the skilled reader of this specification will readily perceive that the present invention encompasses a large number of embodiments without departing from the spirit and scope of the appended claims.

What is claimed is:

1. A container comprising a container body having a lower standing surface and an upper open mouth, a lid sealingly connected to said container body to close said open mouth, a sealing joint on said container body disposed continuously around said mouth; said lid being sealingly connected to the container body by said sealing joint, said sealing joint being disposed in a plane which forms an acute angle with a plane containing said standing surface, said container body including an internal shoulder extending at least partially around said open mouth, at least a portion of said sealing joint being on said shoulder, at least a portion of said internal shoulder being positioned below said open mouth in an arrangement such that said lid forms an angle with a plane containing said open mouth.

2. A container as claimed in claim 1 wherein said container body has an opening edge surface extending over a portion of the circumference of said open mouth, said shoulder merging with said opening edge surface, said sealing joint being on said opening edges surface, said lid being connected to said shoulder and said opening edge surface by said joint.

3. A container as claimed in claim 2 wherein said opening edge surface constitutes an upper bounding surface for the open mouth of the container body.

4. A container as claimed in claim 3 wherein said container body includes a flared flange having an upper bounding surface which constitutes said opening edge surface.

5. A container as claimed in claim 1 wherein said shoulder includes at least one ridge to which said lid is sealingly connected.

6. A container as claimed in claim 5 wherein said container body includes a flared flange merging with said shoulder, said ridge extending on said shoulder.

7. A container as claimed in claim 1 wherein said container body includes a flared flange merging with said shoulder and a ridge on said flange and shoulder forming a weld indication line for said sealing joint between the lid and the flange and shoulder.

8. A container as claimed in claim 7 wherein said ridge extends around the circumference of said open mouth.

9. A container as claimed in claim 1 wherein said plane containing said open mouth extends parallel to the plane containing said standing surface, said shoulder extending from the level of said open mouth at its highest point to a level below said open mouth at its lowest point and having a surface which lies in said plane which forms an acute angle with the plane containing said standing surface.

10. A container as claimed in claim 9 wherein said container body includes an outwardly projecting flange which merges with said shoulder.

11. A container as claimed in claim 10 wherein said shoulder and said flange cooperatively define a circumferential edge portion by which the container body can be externally supported during a filling operation.

12. A method of filling and sealing a container having an open mouth and a bottom standing surface with contents including a liquid, said method comprising supporting the container with its open mouth facing upwardly, filling the container with material including a liquid and sealingly afixing a lid to the container to form a seal therewith around the open mouth in a position in which (a) the lid is substantially parallel to the surface of the liquid and forms an acute angle with the bottom standing surface of the container and (b) the lid is affixed to the container in an orientation in which it forms an angle with said open mouth and is at least partly recessed in said container.

13. A method as claimed in claim 12 wherein the lid is sealingly affixed to the container with a spacing above the level of the upper surface of the liquid so that when the container rests on its bottom standing surface, the liquid will contact the now inclined lid.

14. A method as claimed in claim 13 wherein the liquid contacts the lid over a substantial portion of said lid.

* * * * *